US005529218A

United States Patent [19]

Favre et al.

[11] Patent Number: 5,529,218

[45] Date of Patent: Jun. 25, 1996

[54] TAMPER EVIDENT PROTECTION FOR A DISPENSER OF LIQUID OR PASTRY PRODUCTS

[75] Inventors: Bernard Favre, Sceaux; Eric Pourbaix, Courbevoie, both of France

[73] Assignees: Lir France, Chevilly-Larue; Guerlain Societe Anonyme, Paris, both of France

[21] Appl. No.: 510,062

[22] Filed: Aug. 1, 1995

[30] Foreign Application Priority Data

Aug. 1, 1994 [FR] France ..... 94 09534

[51] Int. Cl.[6] ..... B67B 5/00

[52] U.S. Cl. ..... 222/153.13; 222/321.9; 222/494

[58] Field of Search ..... 222/153.13, 380, 222/321.9, 153.11, 494; 215/253

[56] References Cited

U.S. PATENT DOCUMENTS

| | | | |
|---|---|---|---|
| 4,494,680 | 1/1985 | Corsette | 222/380 X |
| 5,040,702 | 8/1991 | Knickerbocker et al. | 222/380 X |
| 5,207,359 | 5/1993 | Steijns | 222/380 X |
| 5,228,600 | 7/1993 | Steijns et al. | 222/380 X |
| 5,445,299 | 8/1995 | Harriman | 222/153.13 X |

FOREIGN PATENT DOCUMENTS

| | | |
|---|---|---|
| 0042039 | 12/1981 | European Pat. Off. . |
| 0344483 | 12/1989 | European Pat. Off. . |
| 1506243 | 12/1967 | France . |

*Primary Examiner*—Gregory L. Huson
*Attorney, Agent, or Firm*—Young & Thompson

[57] ABSTRACT

A dispenser for a liquid or pasty product, comprising a casing (1) containing at least one reservoir of product to be dispensed, a pump associated with the reservoir and actuated by a pusher (3) and a dispensing nose (2) of thermoplastic material on the pusher (5) and adapted to receive the product from an outlet of the pump. The nose (2) comprises two sealing lips (4) arranged to spread elastically under the pressure of the product. The nose (2) is molded of one piece with a tongue (5) to which the nose is connected by at least one thin tab (6). The tongue (5) is disposed between the nose (2) and the casing (1) in such a way as to block the pusher until such time as the tongue (5) is torn from the nose (2) by severing the thin tab or tabs (6).

3 Claims, 1 Drawing Sheet

FIG.1
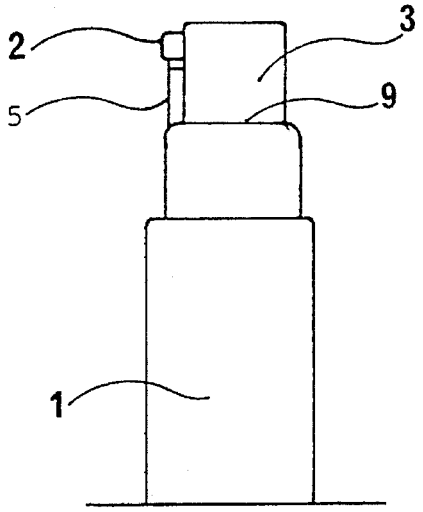
FIG.2
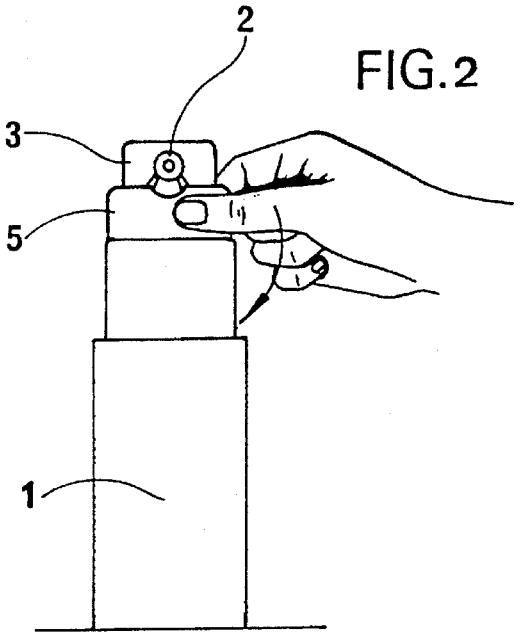
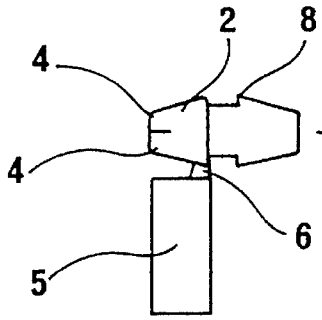
FIG.3
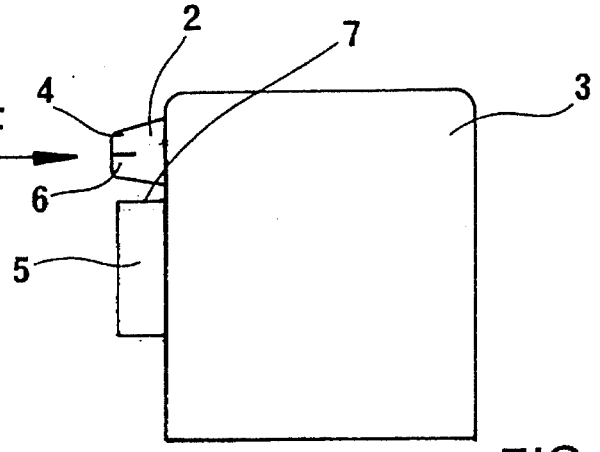
FIG.4
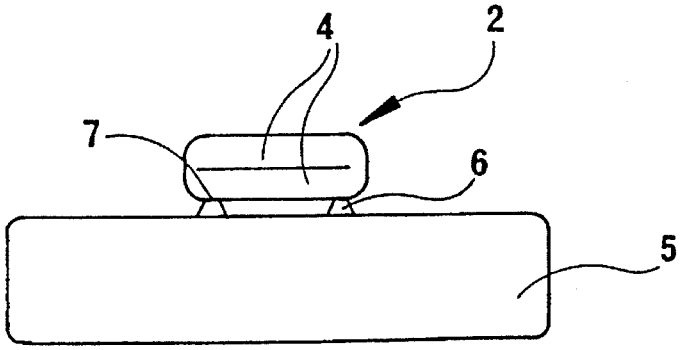
FIG.5

TAMPER EVIDENT PROTECTION FOR A DISPENSER OF LIQUID OR PASTRY PRODUCTS

The invention relates to a dispenser for liquid or pasty products, such as cosmetic products, of the type comprising a casing containing at least one reservoir of product to be dispensed, a pump associated with said reservoir and actuated by a pusher, and a dispensing nose of thermoplastic material snapped on the pusher in communication with the outlet of the pump, said nose comprising two sealing lips arranged to separate elastically under the pressure of the product.

Dispensers of this type have had considerable commercial success because of their reliability, their simplicity of manufacture and of use, as well as the protection, particularly as to oxidation, which they ensure for the product to be dispensed.

These dispensers must in general be protected as to the guarantee that they have not been previously used and that they are as the manufacturer has packaged them.

Generally, this guarantee is given by a rupture of a packaging element, for example the transparent envelope of the packaging, or of a connecting seal between the casing and a cover fixed to the latter. These types of protection are relatively burdensome and not always very effective.

The present invention has for its object to provide a new tamper evident protection for a dispenser of the type described in the introduction, whose cost is practically nothing, with maximum effectiveness.

To this end, the protection according to the invention is characterized in that said nose is molded of a single piece with a tongue to which it is connected by at least one thin tab, the assembly being arranged such that, during emplacing said nose, the tongue is disposed between said nose and the casing so as to block the pusher.

The user therefore must, before being able to actuate the pusher, withdraw the guarantee tongue by pulling up and causing the cutting of the thin tab. The guarantee thus given is very good and reassuring for the user. The cost of the guarantee is reduced practically to the value of its material because it is fabricated and positioned at the same time as the dispensing nose.

The invention will be better understood from a reading of the following description given with reference to the accompanying drawing, in which:

FIG. 1 is a schematic side elevational view of a dispenser provided with a guarantee according to one embodiment of the invention, FIG. 2 is a schematic front view of the assembly of the figure, the guarantee tongue being in the course of being broken, FIG. 3 is a side elevational view of a dispensing nose associated with a guarantee tongue, FIG. 4 shows the assembly of FIG. 3 after positioning on the pusher of the dispenser and FIG. 5 is a view from the left of FIG. 3.

The dispenser comprises a casing 1 containing at least one reservoir provided with a pump (not shown) whose outlet is connected to a dispensing nose 2 mounted on a pusher 3. The nose 2 is of thermoplastic material and comprises two dispensing lips 4 which spread elastically apart under pressure of the product to be dispensed. This product can be liquid or pasty. The lips 4 ensure that the product remaining between the pump outlet and the outlet of the dispensing nose is shielded from the air, hence from oxidation.

According to the invention, a guarantee tongue 5 is molded in one piece with the dispensing nose 2 to which it is connected, in the example described, by two thin tabs 6, of substantially triangular shape, such that the connection 7 between one tab 6 and the nose 2 is thinned and constitutes a zone of weakness or a point of rupture.

The assembly of the dispensing nose 2 - protective tongue 5 is produced from a single piece with the connection tabs 6 by injection of a thermoplastic material having suitable properties of elasticity to ensure the elastic deformation of the lips 4 of the dispensing nose 2. This assembly is automatically displaced in the direction of the arrow F so that a shouldered supplemental part 8 of the nose 2 will have snap engagement into a receiving recess of the pusher 3. The tongue 5 becomes lodged between the base of the nose 2 and the upper surface 9 of the casing 1, which prevents pressing down the pusher 3. The first user must tear off this tongue 5 by lateral traction thereby rupturing the connections 7 between the tabs 6 and the dispensing nose 2.

We claim:

1. In a dispenser for a liquid or pasty product, comprising a casing (1) containing at least one reservoir of product to be dispensed, a pump associated with said reservoir and actuated by a pusher (3) and a dispensing nose (2) of thermoplastic material on the pusher (5) and adapted to receive said product from an outlet of the pump, said nose (2) comprising two sealing lips (4) arranged to spread elastically under the pressure of the product; the improvement wherein said nose (2) is molded of one piece with a tongue (5) to which said nose is connected by at least one thin tab (6), the tongue (5) being disposed between said nose (2) and the casing (1) in such a way as to block the pusher until such time as the tongue (5) is torn from the nose (2) by severing said at least one thin tab (6).

2. Dispenser according to claim 1, wherein said at least one thin tab (6) is connected to said nose (2) by a rupture point.

3. Dispenser according to claim 2, wherein said rupture point is formed by a thinned region (7) of the tab (6).

* * * * *